US010369798B2

(12) United States Patent
Mori

(10) Patent No.: US 10,369,798 B2
(45) Date of Patent: Aug. 6, 2019

(54) RECORDING APPARATUS

(71) Applicant: SEIKO EPSON CORPORATION, Tokyo (JP)

(72) Inventor: Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/865,900

(22) Filed: Jan. 9, 2018

(65) Prior Publication Data

US 2018/0201020 A1 Jul. 19, 2018

(30) Foreign Application Priority Data

Jan. 18, 2017 (JP) ..... 2017-006967
Sep. 13, 2017 (JP) ..... 2017-175977

(51) Int. Cl.
*B41J 2/165* (2006.01)
*B41J 25/316* (2006.01)

(52) U.S. Cl.
CPC ..... *B41J 2/16588* (2013.01); *B41J 2/16508* (2013.01); *B41J 2/16547* (2013.01); *B41J 25/316* (2013.01)

(58) Field of Classification Search
CPC ..... B41J 2/16588; B41J 2/16508; B41J 2/16547; B41J 25/316
USPC ..... 347/33
See application file for complete search history.

(56) References Cited

U.S. PATENT DOCUMENTS 5,206,666 A 4/1993 Watanabe et al.
2002/0015070 A1* 2/2002 Taylor ..... B41J 2/16547 347/32
2004/0227784 A1 11/2004 Lodal et al.
2008/0231653 A1 9/2008 Kawashima et al.
2009/0033706 A1 2/2009 Ehresmann et al.
(Continued)

FOREIGN PATENT DOCUMENTS

JP 2012-166554 A 9/2012
JP 2013-078861 A 5/2013
(Continued)

OTHER PUBLICATIONS

European Search Report issued in Application No. 17209858 dated May 16, 2018.

*Primary Examiner* — Huan H Tran
*Assistant Examiner* — Alexander D Shenderov
(74) *Attorney, Agent, or Firm* — Workman Nydegger

(57) ABSTRACT

A recording apparatus includes: a recording head; a transportation path along which the medium is transported via a head facing region which faces the recording head; and a maintenance unit used for maintenance of the recording head, wherein the head facing region, which is a region of the transportation path which faces the recording head, is inclined with respect to a horizontal direction, and the recording head is provided to be rotatable, and when rotating, the recording head can be switched between a first position in which the head surface is inclined along an inclination of the head facing region, the first position being a position for performing recording, and a second position in which the head surface becomes horizontal or becomes more horizontal than in the first position, the second position being a position for performing maintenance by the maintenance unit.

11 Claims, 7 Drawing Sheets

(56) References Cited

U.S. PATENT DOCUMENTS

| | | | | |
|---|---|---|---|---|
| 2009/0073213 | A1* | 3/2009 | Iwata | B41J 2/16588 347/19 |
| 2013/0083103 | A1 | 4/2013 | Kakigahara | |
| 2016/0107447 | A1 | 4/2016 | Reder et al. | |

FOREIGN PATENT DOCUMENTS

| | | | |
|---|---|---|---|
| JP | 2015-051574 | A | 3/2015 |
| JP | 2016-104569 | A | 6/2016 |

* cited by examiner

RECORDING APPARATUS

CROSS REFERENCES TO RELATED APPLICATIONS

The entire disclosure of Japanese Patent Application Nos. 2017-006967, filed Jan. 18, 2017 and 2017-175977, filed Sep. 13, 2017 are expressly incorporated by reference herein.

BACKGROUND

1. Technical Field

The present disclosure relates to recording apparatuses that perform recording onto a medium.

2. Related Art

Ink jet printers, which are examples of the recording apparatus, are configured to pick up a paper sheet from a paper sheet cassette, transport the paper sheet to a position which faces a recording head, perform recording onto the paper sheet, and output the recorded paper sheet. More specifically, one example of the printer is configured to turn over the paper sheet picked up from the paper sheet cassette, perform recording after the paper sheet is transported to the position which faces the recording head, and again turn over the recorded paper sheet to output the paper sheet face down onto an output tray. Typically, a maintenance unit that performs maintenance for the recording head is provided. The maintenance unit is configured with, for example, a cap that seals the recording head, and a wiper that wipes the head surface.

In a type of the printer in which the recording head moves in the paper sheet width direction, that is, a so-called serial type printer that performs recording by alternately repeating a recording operation of the recording head ejecting ink while moving in the paper sheet width direction and a transporting operation of a paper sheet by a predetermined distance, the maintenance unit is provided outside the recording region so that the recording head moves to a position of the maintenance unit as necessary to perform maintenance. On the other hand, in a type of the printer in which the recording head does not move, that is, a so-called line head type printer having the ink ejecting nozzles arranged to cover the entire paper sheet width, a configuration to replace a platen and a maintenance unit is required as described in JP-A-2013-78861 and JP-A-2015-51574.

In the configuration described in JP-A-2013-78861, the maintenance unit is provided on the lower side of the platen that faces the head surface. When sealing the head surface, the platen opens to the lower side so that the maintenance unit moves upward toward the head surface and seals the head surface. As a result, in the configuration described in JP-A-2013-78861, the up and down movement range of the maintenance unit needs to be increased to ensure the opening space of the platen, which requires a large dead space (a space in which other components cannot be provided), leading to an increase in size of the apparatus.

Further, in the configuration described in JP-A-2015-51574, a configuration is adopted in which the maintenance unit laterally enters a space which is formed by the recording head moving upward. However, in this configuration, since the maintenance unit is positioned above the transportation path, the recording head needs to be moved upward by a certain distance. As a result, the up and down movement range of the recording head needs to be increased, which requires a large dead space (a space in which other components cannot be provided), leading to an increase in size of the apparatus as well.

Further, the configuration described in JP-A-2013-78861 has another technical problem. Since the printer is configured to turn over the paper sheet picked up from the paper sheet cassette and transport the paper sheet to the position which faces the recording head, perform recording, and again turn over the recorded paper sheet to output the paper sheet onto the output tray, the size of the apparatus disadvantageously increases due to a long transportation path. In addition, a paper jam in the transportation path is also likely to occur due to the long transportation path.

SUMMARY

An advantage of some aspects of the disclosure is that it provides a configuration for performing maintenance for a recording head while reducing a dead space formed by operating components (a space in which other components cannot be provided) to thereby downsize the apparatus. In addition to the above advantage, another advantage of some aspects of the disclosure is that it prevents an increase in size of the apparatus and reduces a paper jam in the transportation path by reducing the length of the paper sheet transportation path. The disclosure has been made to achieve either of the advantages described above.

According to an aspect of the disclosure, a recording apparatus including: a recording head having a head surface on which liquid ejection nozzles that eject liquid droplets onto a medium are arranged, the recording head being configured to perform recording onto the medium; a transportation path along which the medium is transported via a head facing region which faces the recording head; and a maintenance unit used for maintenance of the recording head, wherein the head facing region, which is a region of the transportation path which faces the recording head, is inclined with respect to a horizontal direction, and the recording head is provided to be rotatable, and when rotating, the recording head can be switched between a first position in which the head surface is inclined along an inclination of the head facing region, the first position being a position for performing recording, and a second position in which the head surface becomes horizontal or becomes more horizontal than in the first position, the second position being a position for performing maintenance by the maintenance unit.

Accordingly, since the recording apparatus includes: a recording head having a head surface on which liquid ejection nozzles that eject liquid droplets onto a medium are arranged, the recording head being configured to perform recording onto the medium; a transportation path along which the medium is transported via a head facing region which faces the recording head; and a maintenance unit used for maintenance of the recording head, wherein the head facing region, which is a region of the transportation path which faces the recording head, is inclined with respect to a horizontal direction, and the recording head is provided to be rotatable, and when rotating, the recording head can be switched between a first position in which the head surface is inclined along an inclination of the head facing region, the first position being a position for performing recording, and a second position in which the head surface becomes horizontal or becomes more horizontal than in the first position, the second position being a position for performing maintenance by the maintenance unit, an operation area for the components which operate for maintenance of the recording head (in this aspect, the operation area for the recording head) can be reduced. That is, a dead space in which other components cannot be provided can be reduced, contributing to downsizing of the apparatus (the details will be described later). In addition, since the recording head assumes the position (the second position) during a maintenance operation more horizontal than the position (the first position) during a recording operation, the maintenance operation of the recording head can be appropriately performed (the details will be described later). Further, the transportation path of the medium can also be shortened, thereby preventing an increase in size of the apparatus or reducing a medium jam in the transportation path (the details will be described later).

In the above aspect of the disclosure, the recording head is configured to rotate about a rotation shaft which is disposed extending in a direction perpendicular to a transportation direction of the medium. Accordingly, in the configuration having the maintenance unit used for maintenance of the recording head, the aforementioned effect of the above aspect can be obtained.

In the above aspect of the disclosure, the maintenance unit is provided to be displaceable between a non-maintenance position which is separated from the head surface of the recording head which is assuming the first position, and a maintenance position which is close to the head surface of the recording head which is assuming the second position. Accordingly, in the configuration having the maintenance unit used for maintenance of the recording head, the aforementioned effect of the above aspect can be obtained.

In the above aspect of the disclosure, the maintenance unit is disposed at a position to which the recording head comes closer in the horizontal direction when the recording head is switched from the first position to the second position, and is displaced in the horizontal direction. Accordingly, since the maintenance unit is disposed at a position to which the recording head comes closer in the horizontal direction when the recording head is switched from the first position to the second position and is displaced in the horizontal direction, the distance between the non-maintenance position and the maintenance position of the maintenance unit can be shortened, thereby contributing to downsizing of the apparatus and reducing the period of time required for movement of the maintenance unit.

In the above aspect of the disclosure, the maintenance unit is configured to be horizontally displaced from the non-maintenance position to a position before the maintenance position, and then displaced upward from the position before the maintenance position to the maintenance position. Accordingly, since the maintenance unit is configured to be horizontally displaced from the non-maintenance position to a position before the maintenance position, and then displaced upward from the position before the maintenance position to the maintenance position, the recording head can be reliably sealed in the configuration in which the recording head is sealed by the maintenance unit.

In the above aspect of the disclosure, the maintenance unit moves in the vertical direction to thereby switch the non-maintenance position and the maintenance position. Accordingly, in the configuration in which the maintenance unit moves in the vertical direction to thereby switch the non-maintenance position and the maintenance position, the aforementioned effect of the above aspect can be obtained.

In the above aspect of the disclosure, the recording apparatus includes a coordination mechanism, and the coordination mechanism displaces the maintenance unit in coordination with positional switching of the recording head.

Accordingly, since the recording apparatus includes a coordination mechanism, and the coordination mechanism displaces the maintenance unit in coordination with positional switching of the recording head, there is no need of providing separate drive power sources for the head unit and the maintenance unit, thereby reducing the cost of the apparatus.

In the above aspect of the disclosure, a portion of the transportation path downstream from the head facing region, which forms a curved path provided with the recording head disposed inside thereof, is configured as an output path which allows for face down output of the medium.

Accordingly, since a portion of the transportation path downstream from the head facing region, which forms a curved path provided with the recording head disposed inside thereof, is configured as an output path which allows for face down output of the medium, the effect of the above aspect that does not need of ensuring a large space above the recording head can be effectively used, thereby reducing the dimension of the apparatus in the height direction. In addition, since the face down output configuration is provided with the head facing region inclined with respect to the horizontal direction, the dimension of the apparatus in the width direction or depth direction can be reduced (the details will be described later).

In the above aspect of the disclosure, the recording head includes the liquid ejection nozzles arranged over the entire region in the medium width direction, which is a direction perpendicular to the medium transportation direction. Accordingly, in the configuration in which the recording head includes the liquid ejection nozzles arranged over the entire region in the medium width direction, which is a direction perpendicular to the medium transportation direction, the aforementioned effect of the above aspect can be obtained.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

With reference to the drawings, an embodiment of the present disclosure will be described. However, the present disclosure is not limited to the embodiment described below. Various modifications are contemplated within the scope of the disclosure as defined in the appended claims, such modifications should be included in the scope of the present disclosure. In the following description, an embodiment of the present disclosure will be described as being included in the scope of the present disclosure.

Figure 1:
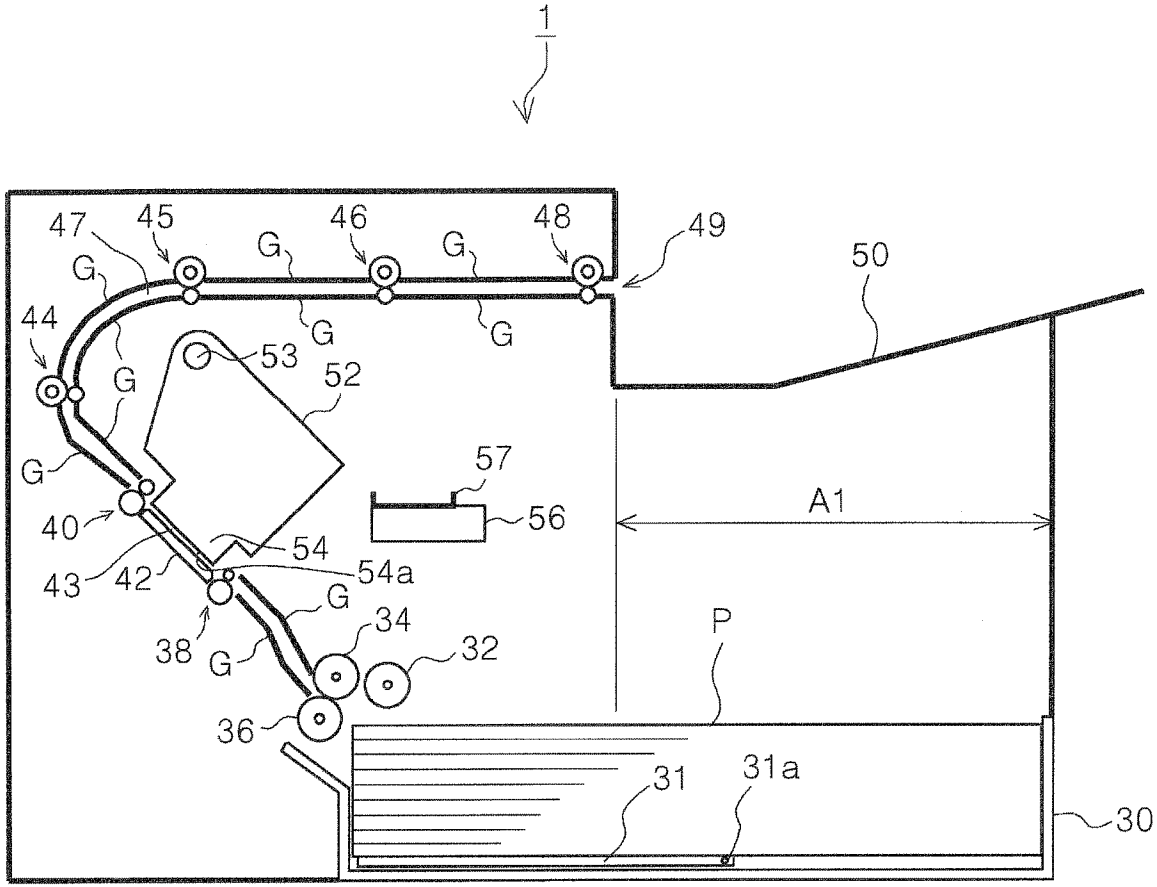
FIG. 1 is a schematic diagram of a paper sheet transportation path of an ink jet printer according to the disclosure.
Figure 2:
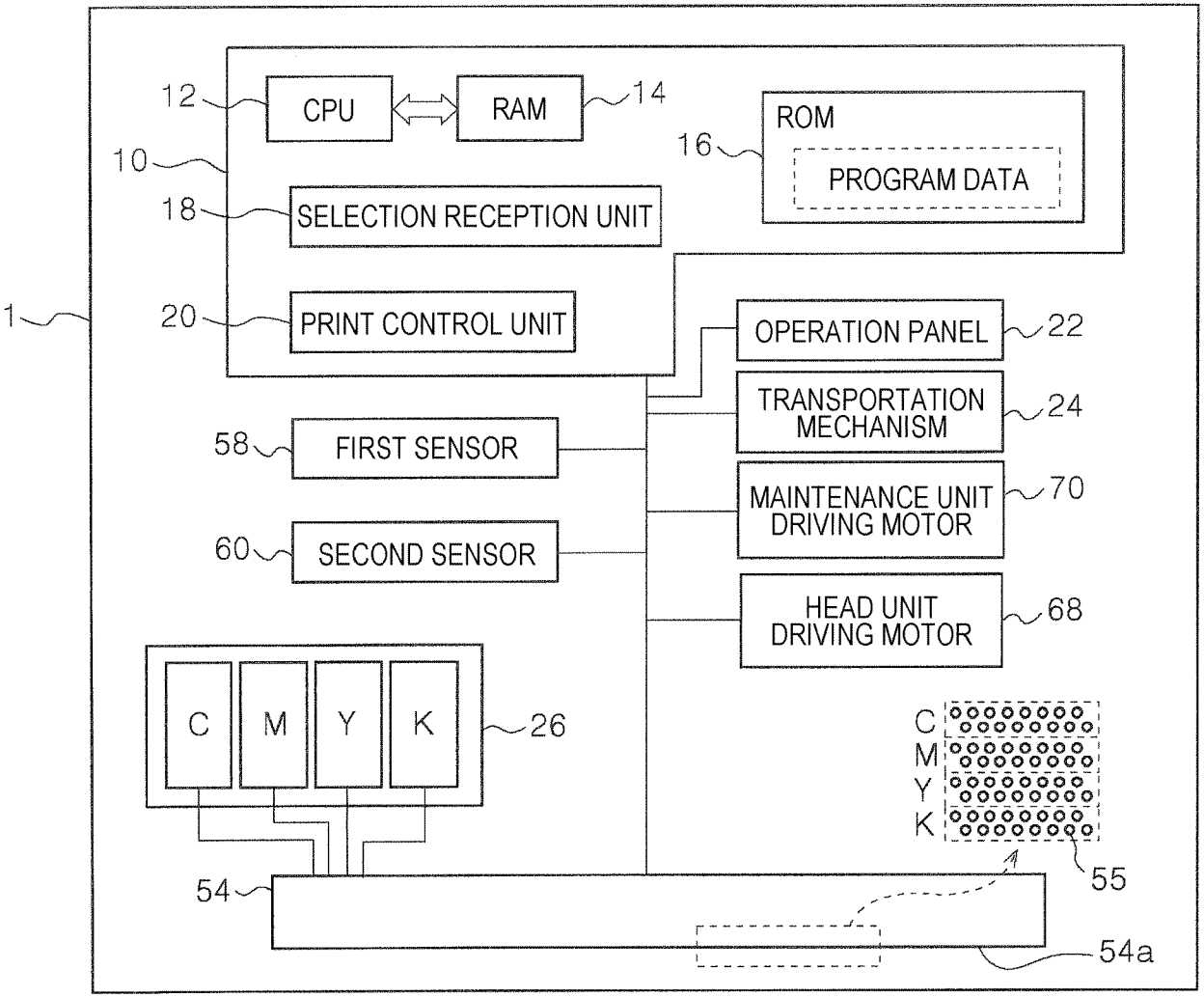
FIG. 2 is a block diagram which schematically illustrates a control system of the ink jet printer according to the disclosure.
Figure 3:
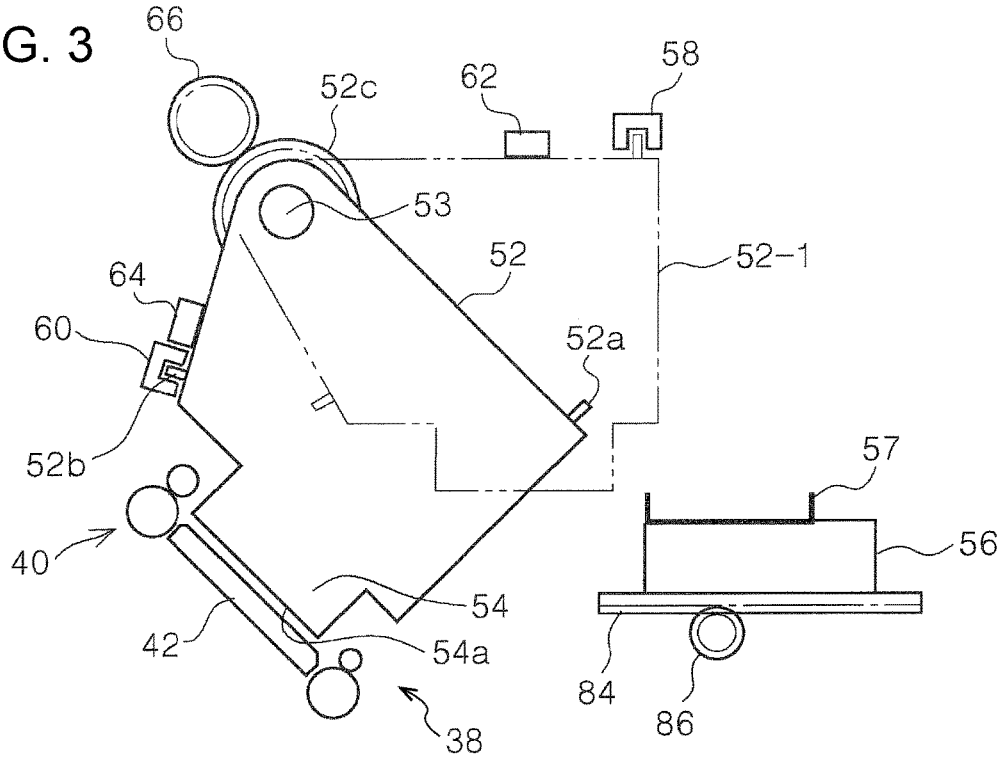
FIG. 3 is a side view of a head unit and a surrounding configuration thereof (first embodiment).
Figure 4:
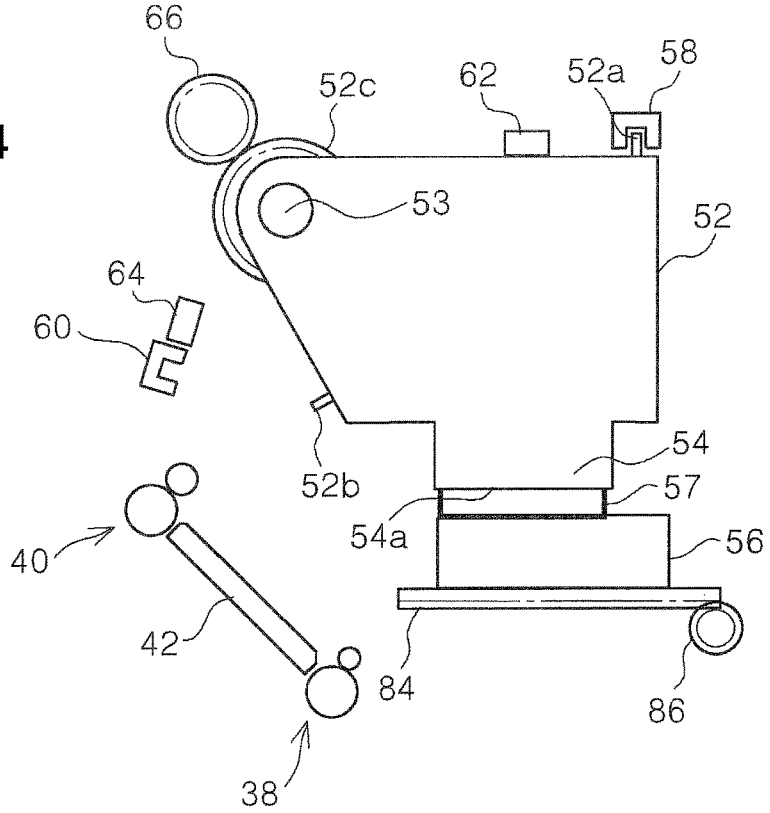
FIG. 4 is a side view of a head unit and a surrounding configuration thereof (first embodiment).
Figure 5:
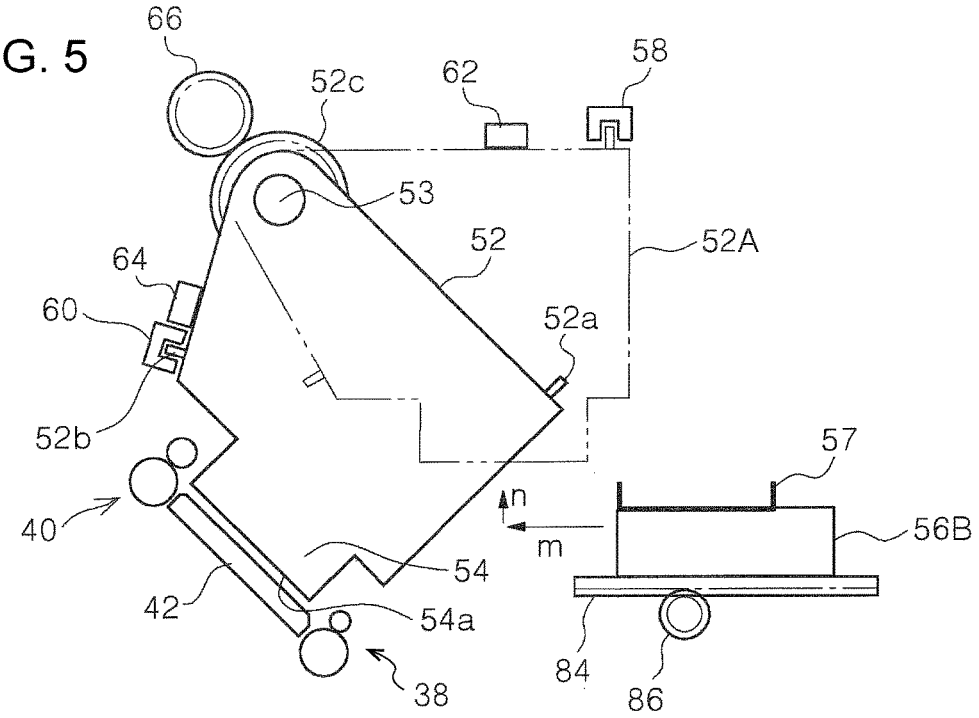
FIG. 5 is a side view of a head unit and a surrounding configuration thereof (second embodiment).
Figure 6:
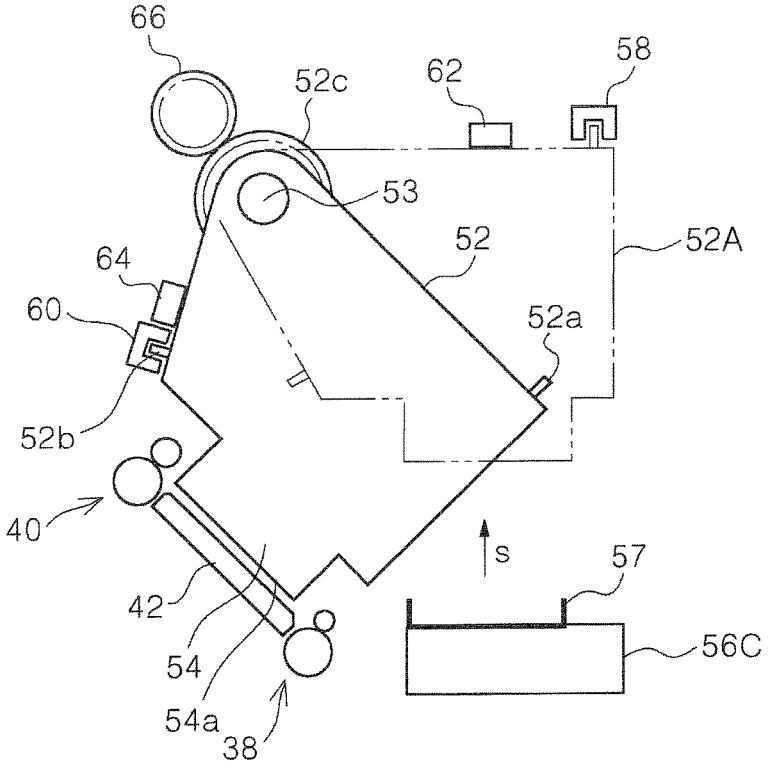
FIG. 6 is a side view of a head unit and a surrounding configuration thereof (third embodiment).
Figure 7:
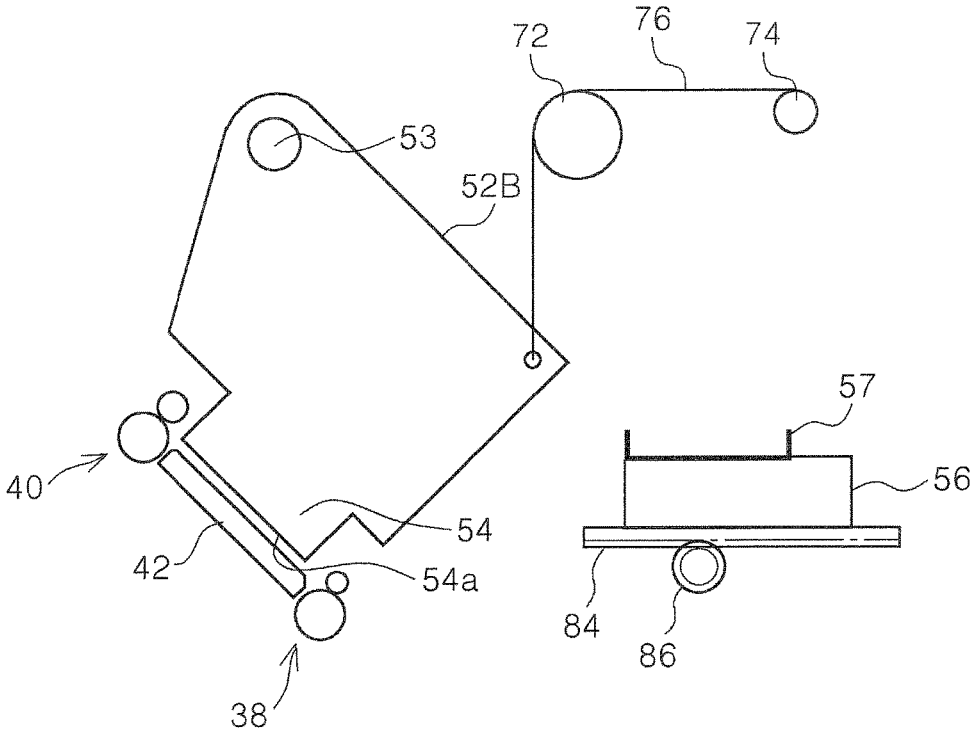
FIG. 7 is a side view of a head unit and a surrounding configuration thereof (fourth embodiment).
Figure 8:
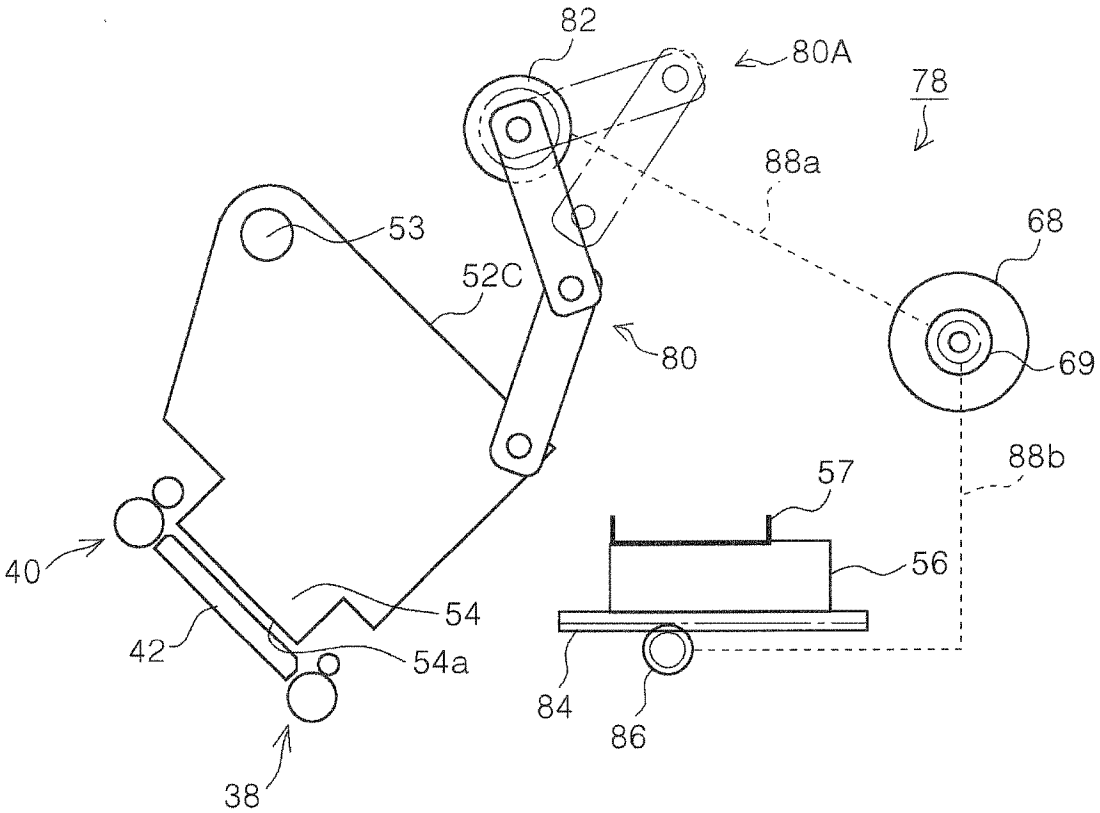
FIG. 8 is a side view of a head unit and a surrounding configuration thereof (fifth embodiment).
Figure 9:
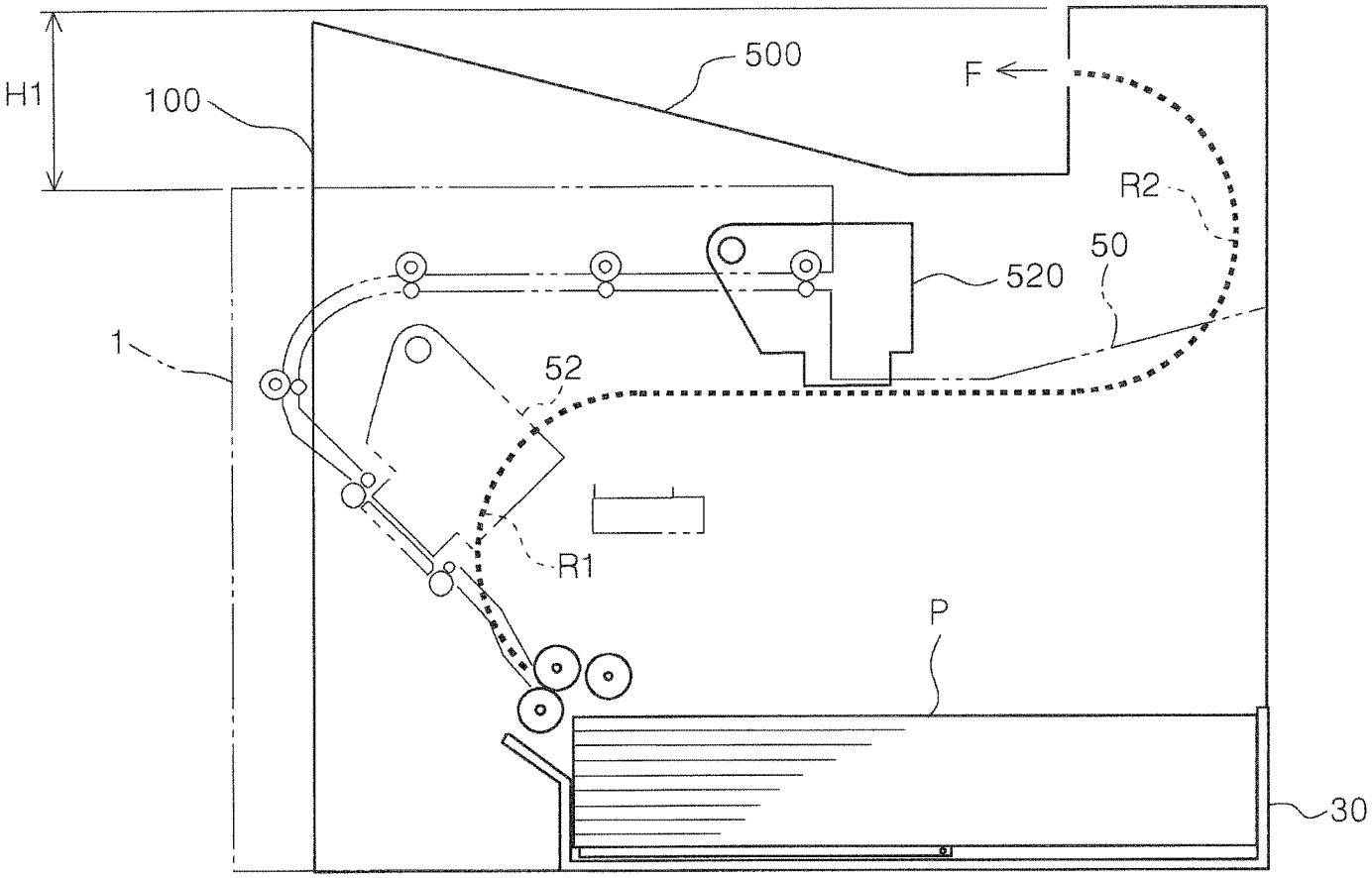
FIG. 9 is a schematic diagram which illustrates the paper sheet transportation path of the ink jet printer according to the disclosure and a paper sheet transportation path of an ink jet printer according to a comparative example.

FIG. 1 is a schematic diagram of a paper sheet transportation path of an ink jet printer (hereinafter, referred to as a "printer") 1, which is an embodiment of a "recording apparatus" according to the disclosure, and FIG. 2 is a block diagram which schematically illustrates a control system of the printer 1. Further, FIGS. 3 to 8 are side views of a head unit 52 and a surrounding configuration thereof. FIGS. 3 and 4 illustrate a first embodiment, FIG. 5 illustrates a second embodiment, FIG. 6 illustrates a third embodiment, FIG. 7 illustrates a fourth embodiment, and FIG. 8 illustrates a fifth embodiment. Further, FIG. 9 is a schematic diagram which illustrates the paper sheet transportation path of the printer 1 according to the present embodiment and a paper sheet transportation path of an ink jet printer according to a comparative example. In the present embodiment, the left-right direction in FIG. 1 is referred to as an apparatus width direction, a front surface of the sheet of drawing of FIG. 1 is referred to as an apparatus front surface, and the up-down direction in FIG. 1 is referred to as a vertical direction.

With reference to FIGS. 1 and 2, an overall configuration of the printer 1 will be described. In FIG. 1, the printer 1 includes a paper sheet cassette 30 removably attached to a bottom of the apparatus. The paper sheet cassette 30 houses recording papers P which are examples of a medium. The paper sheet cassette 30 is provided with a hopper 31 and the hopper 31 is configured to swing about a swing shaft 31*a* by receiving a driving force from a driving source, which is not shown in the figure, to thereby cause the recording papers P housed in the paper sheet cassette 30 to be in contact with or separated from a pick-up roller 32 rotated by a motor, which is not shown in the figure.

The recording papers P fed out from the paper sheet cassette 30 by the pick-up roller 32 are separated (for double-feeding prevention) when passing through a nip between the feed roller 34 and the separation roller 36 and fed downstream to a pair of upstream transportation rollers 38. Hereinafter, a transportation path from the paper sheet cassette 30 to the pair of upstream transportation rollers 38 is referred to as a "supply transportation path." The paper sheet transportation path between the pair of upstream transportation rollers 38 and a pair of downstream transportation rollers 40 is configured as a head facing region 43 in which the recording paper P faces the recording head 54. In the head facing region 43, recording is performed by the recording head 54 onto the recording paper P. A platen 42 that supports the recording paper P is disposed in the head facing region 43. Hereinafter, a transportation path from the pair of upstream transportation rollers 38 to the pair of downstream transportation rollers 40 is referred to as a "recording transportation path." In the present embodiment, the head facing region 43 that constitutes the recording transportation path of the printer 1 as shown in the figure is inclined with respect to the horizontal direction. Further, the supply transportation path is inclined in the inclination direction of the recording transportation path to be connected to the recording transportation path. That is, the supply transportation path and the recording transportation path are connected to each other in a substantially linear shape. The supply transportation path and the recording transportation path as well as an output path 47 described later are collectively referred to as a "paper sheet transportation path." Further, the reference character G in FIG. 1 indicates a guide member that constitutes the paper sheet transportation path.

The recording head 54 is disposed on the head unit 52. The recording head 54 in the present embodiment includes ink ejection nozzles 55 (FIG. 2) which are examples of the "liquid ejection nozzles," and a plurality of the ink ejection nozzles 55 (FIG. 2) are arranged to cover the entire range in the paper sheet width direction. The recording head 54 is configured as a so-called line head type recording head, which can perform recording onto the entire paper sheet width without a need of movement in the paper sheet width direction. The head unit 52 is provided to be rotatable, the detail of which will be described later.

The printer 1 includes a maintenance unit 56. The maintenance unit 56 includes a cap 57, and the cap 57 seals a head surface 54*a* of the recording head 54. The cap 57 seals the head surface 54*a* of the recording head 54 to thereby prevent ink in the ink ejection nozzles 55 from being dried. Further, flushing can be performed while the cap 57 seals the head surface 54*a* of the recording head 54 or while the cap 57 faces the head surface 54*a* of the recording head 54. Flushing is an operation of ejecting ink from the ink ejection nozzles 55 of the recording head 54 into the cap 57. The maintenance unit 56 is provided to be displaceable, the detail of which will be described later.

A portion of the paper sheet transportation path of the printer 1 downstream from the head facing region 43 forms a curved path while the recording head 54 (head unit 52) is disposed inside thereof. The curved path is configured as an output path 47 that ensures face down output of the recording paper P, and the recorded recording paper P is reversed and fed along the output path 47 with the recording surface facing inside. More specifically, the output path 47 is a portion of the transportation path from the pair of downstream transportation rollers 40 to the pair of output rollers 48. Reference characters 44, 45 and 46 each indicate pairs of the feed rollers disposed in the output path 47.

The recording paper P transported in the output path 47 is output to a face down output tray 50 by the pair of output rollers 48 disposed at a paper sheet output port 49 with the recording surface facing down.

Subsequently, with reference to FIG. 2, a control system of the printer 1 will be described. The printer 1 includes a control unit 10 that controls an ink ejection process (printing process). The control unit 10 includes a CPU 12, RAM 14, ROM 16, selection reception unit 18, and a print control unit 20. The selection reception unit 18 and the print control unit 20 are components configured with a software. In the control unit 10, the CPU 12 deploys a program data stored in a memory such as the ROM 16 into the RAM 14, and performs calculation according to the program data to thereby execute a firmware for controlling the control targets. The firmware is a program that allows the CPU 12 to perform functions of the selection reception unit 18, the print control unit 20, and the like.

The print control unit 20 generates a print data from an image data. The image data can be inputted via a memory card, which is not shown in the figure, connected to a memory card slot of the printer 1, which is not shown in the figure. Alternatively, the print data is generated by a printer driver installed in an external computer, which is not shown in the figure, connected to the printer 1. The control unit 10 can receive a print data from the external computer.

The printer 1 includes an ink tank unit 26 having a plurality of ink tanks. In the example shown in FIG. 2, the ink tank unit 26 houses the ink tanks which correspond to each of cyan (C), magenta (M), yellow (Y), and black (K) ink. The ink tank unit 26 is connected to the recording head 54 do that each color of ink is supplied from the ink tank unit 26 to the recording head 54.

As described above, the recording head 54 includes the plurality of ink ejection nozzles 55. In FIG. 2, part of the CMYK nozzle rows on the head surface 54*a* of the recording head 54 is illustrated in an area surrounded by a dotted line. The CMYK nozzle rows are each arranged in the paper sheet transportation direction.

The print control unit 20 generates a drive signal for driving the recording head 54, transportation mechanism 24, and the like on the basis of the print data. The transportation mechanism 24 is configured with a motor that drives the rollers for feeding and transporting the recording paper P as described with reference to FIG. 1, and the like, which are not shown in the figure.

The printer 1 further includes an operation panel 22. The operation panel 22 includes a display (for example, a liquid crystal panel), not shown in the figure, a touch panel disposed in the display, and various buttons and keys, and is configured to receive an input from a user and displays a required UI screen on the display unit.

The maintenance unit 56 (FIG. 1) is provided to be displaceable between a non-maintenance position (indicated by the solid line in FIG. 3) and a maintenance position (indicated by the solid line in FIG. 4) under control by the control unit 10. A maintenance unit driving motor 70, which is a driving source that displaces the maintenance unit 56, is controlled by the control unit 10.

Further, the head unit 52 (FIG. 1) having the recording head 54 is provided to be rotatable about a rotation shaft 53 (FIG. 1) under control of the control unit 10. When rotating, the head unit 52 is switched between a first position (indicated by the solid line in FIG. 3) in which the head surface 54*a* facing the recording paper P is inclined along the head facing region 43 and a second position (indicated by the solid line in FIG. 4) in which the head surface 54*a* becomes more horizontal than in the first position. The rotation shaft 53 extends in a direction along the extending direction of the nozzle rows disposed in the head unit 52, which is a direction perpendicular to the paper sheet transportation direction. A head unit driving motor 68, which is a driving source for swinging the head unit 52, is controlled by the control unit 10. The position of the head unit 52 is detected by a first sensor 58 and a second sensor 60.

A configuration and an operation of the head unit 52 and the maintenance unit 56 will be further described with reference to FIG. 3 and subsequent drawings. In FIG. 3, the reference character 52*c* indicates a gear integrally formed with the head unit 52, and the gear 52*c* meshes with a unit driving gear 66 which is rotated by the head unit driving motor 68 (FIG. 2). Accordingly, as the unit driving gear 66 is rotated by the head unit driving motor 68 (FIG. 2), the head unit 52 rotates about the rotation shaft 53 and the position of the head unit 52 changes accordingly.

A first abutment unit 62 is disposed on the upper side of the head unit 52, and a second abutment unit 64 is disposed on the rear side of the head unit 52 (on the left side in FIG. 3). The first abutment unit 62 abuts the head unit 52 when the head unit 52 switches from the first position (indicated by the solid line in FIG. 3) to the second position (indicated by the dot-dot-dash line in FIG. 3, the reference character 52-1) to regulate the rotation of the head unit 52 so that the head unit 52 assumes the second position. Similarly, the second abutment unit 64 abuts the head unit 52 when the head unit 52 switches from the second position (indicated by the dot-dot-dash line in FIG. 3, the reference character 52-1) to the first position (indicated by the solid line in FIG. 3) to regulate the rotation of the head unit 52 so that the head unit 52 assumes the first position.

The first sensor 58 is disposed on the upper side of the head unit 52. In the present embodiment, the first sensor 58 is an optical sensor. The head unit 52 is provided with a first detected section 52*a*. When the head unit 52 switches from the first position (indicated by the solid line in FIG. 3) to the second position (indicated by the dot-dot-dash line in FIG. 3, the reference character 52-1), the control unit 10 can detect when the head unit 52 is switched to the second position since the first detected section 52*a* blocks the optical axis of the first sensor 58.

Similarly, the second sensor 60 is disposed on the rear side of the head unit 52. In the present embodiment, the second sensor 60 is also an optical sensor. The head unit 52 is provided with a second detected section 52*b*. When the head unit 52 switches from the second position (indicated by the dot-dot-dash line in FIG. 3, the reference character 52-1) to the first position (indicated by the solid line in FIG. 3), the control unit 10 can detect when the head unit 52 is switched to the first position since the second detected section 52*b* blocks the optical axis of the second sensor 60.

Further, a rack 84 extending in the displacement direction of the maintenance unit 56 is disposed on the lower side of the maintenance unit 56. The rack 84 meshes with a pinion gear 86 which is rotated by the maintenance unit driving motor 70 (FIG. 2). As a result, when the pinion gear 86 is rotated by the maintenance unit driving motor 70 (FIG. 2), the maintenance unit 56 is displaced. In the present embodiment, the displacement direction of the maintenance unit 56 is a direction in the horizontal direction.

In the configuration described above, during recording onto the recording paper P, the head unit 52 assumes the first position (inclined position) and the maintenance unit 56 is positioned at the non-maintenance position, which is separated from the head unit 52 (the state shown in FIG. 3). Further, during a maintenance operation of the recording head 54 or at the completion of the recording job, the head unit 52 is switched from the first position (inclined position) to the second position (horizontal position). After that, the maintenance unit 56 is moved from the non-maintenance position which is separated from the head unit 52 to the maintenance position in which the cap 57 seals the head surface 54*a* (the state shown in FIG. 4).

The maintenance operation of the recording head 54 includes flushing that ejects ink from the ink ejection nozzles 55 toward the cap 57 as described above as well as a suctioning operation in which negative pressure is generated in the cap 57 by a pump, which is not shown in the figure, while the cap 57 seals the recording head 54 to thereby suction ink from the ink ejection nozzles 55. Further, although not shown in the present embodiment, in the configuration in which the maintenance unit 56 has a wiper for wiping off the head surface 54*a* of the recording head 54, the maintenance operation also includes a wiping operation for wiping off the head surface 54*a* by using the wiper.

As described above in the present embodiment, the head facing region 43 of the paper sheet transportation path is inclined with respect to the horizontal direction, and the head unit 52 having the recording head 54 is provided to be rotatable. When rotating, the head unit 52 is switched between the first position in which the head surface 54*a* facing the recording paper P is inclined along an inclination of the head facing region 43 and the second position (in this example, substantially horizontal) in which the head surface 54*a* becomes more horizontal than in the first position. This allows for reduction of the operation area of the components which operate for maintenance of the recording head 54 (in the present embodiment, the operation area of the head unit 52). That is, a dead space in which other components cannot be provided can be reduced, contributing to downsizing of the apparatus.

More specifically, if the head unit 52 is configured to be linearly displaced upward or obliquely upward, a large space is required above the head unit 52 for the displacement of the head unit 52. As a result, as seen from FIG. 1, the output path 47 needs to be further spaced from the head unit 52, leading to an increase in size of the apparatus in the height direction.

In the present embodiment, since the head unit 52 having the recording head 54 as described above is configured to rotate to thereby switch between the first position and the second position, a large space is not required above the head unit 52. Accordingly, a dead space in which other components cannot be provided can be reduced, contributing to downsizing of the apparatus.

Further, as illustrated in FIG. 1, the face down output tray 50 and the paper sheet cassette 30 in the present embodiment are at least partially overlapped with each other in the height direction (vertical direction) of the printer 1 (a range A1 in FIG. 1). As a result, the outer dimension of the printer 1 in the width direction (left-right direction in FIG. 1) can be reduced. Further, since the transportation path from the paper sheet cassette 30 to the face down output tray 50 has a short length and a small number of curved path, a risk of transportation failure (such as paper jam) of the recording paper P in the transportation path can be reduced.

FIG. 9 is a schematic diagram which illustrates the above description, in which the configuration of the printer 1 according to the present embodiment shown in FIG. 1 is indicated by the dot-dot-dash line. The printer indicated by the solid line and the reference character 100 is different from the printer 1 of the present embodiment, and is configured to feed out the recording paper P from the paper sheet cassette 30, perform recording onto the turned recording paper P which has been turned over, and then further turn over the recording paper P for face down output (indicated by the arrow F). The dotted line indicates the transportation path of the printer 100, and the reference character R1 indicates a path along which the recording paper P fed out from the paper sheet cassette 30 is first turned over. Further, the reference character R2 indicates a path along which the recorded recording paper P is turned over for face down output. The reference character 520 indicates a head unit, and the reference character 500 indicates a face down output tray.

As shown in FIG. 9, the printer 100 is configured to feed out the recording paper P from the paper sheet cassette 30, turn over the recording paper P along the turn-over path R1, perform recording onto the turned recording paper P, and then further turn over the recording paper P for face down output (indicated by the arrow F). As a result, a face down output tray 500 is disposed at a position higher than that in the printer 1 of the present embodiment due to the turn-over path R2 provided. Accordingly the printer 100 has a dimension in the height direction (vertical direction) larger than that of the printer 1 of the present embodiment by the amount H1.

On the other hand, the printer 1 of the present embodiment includes the supply transportation path and the recording transportation path which are inclined and linearly arranged, and is configured to perform recording in the recording transportation path and then turn over the recording paper P for output (output path 47). Accordingly, the dimension in the height direction (vertical direction) can be reduced.

In addition, since the recording head 54 assumes a position (second position) during a maintenance operation more horizontal than the position (first position) during a recording operation, that is, substantially a horizontal position in the present embodiment, the maintenance operation of the recording head 54 can be appropriately performed. More specifically, if the position of the recording head 54 during a maintenance operation is an inclined position, ink ejected toward the cap 57 for flushing is likely to overflow from the cap 57. Further, in order to prevent such overflow, the cap 57 is required to be increased in size. However, occurrence of this problem can be avoided since the recording head 54 assumes a position (second position) during a maintenance operation more horizontal than the position (first position) during a recording operation, that is, substantially a horizontal position in the present embodiment.

Further, in the present embodiment, the maintenance unit 56 is provided to be displaceable between the non-maintenance position (FIG. 3) separated from the head surface 54*a*, which is a position in which the recording head 54 (head unit 52) assumes the first position (inclined position), and the maintenance position (FIG. 4) close to the head surface 54*a*, which is a position in which the recording head 54 (head unit 52) assumes the second position (horizontal position). In the present embodiment, the maintenance unit 56 is disposed at a position to which the recording head 54 comes closer when switched from the first position (inclined position) to the second position (horizontal position) (on the right side of the recording head 54 in FIGS. 3 and 4) relative to the recording head 54 in the horizontal direction. As a result, a distance between the non-maintenance position and the maintenance position of the maintenance unit 56 can be reduced, contributing to downsizing of the apparatus. Further, the period of time required for the maintenance unit 56 to move can be reduced. This is obvious when considering the case in which the maintenance unit 56 is disposed on the left side, not on the right side, relative to the recording head 54 in FIGS. 3 and 4.

In the above embodiment, the maintenance unit 56 moves to the horizontal direction and is then displaced between the maintenance position and the non-maintenance position. However, the movement is not limited thereto, and for example, the maintenance unit 56 may be configured to be horizontally displaced from the non-maintenance position to a position before the maintenance position as indicated by the arrow m in FIG. 5, and then displaced upward from the position before the maintenance position to the maintenance position as indicated by the arrow n. FIG. 5 illustrates a second embodiment of the present disclosure, and the reference character 56B in FIG. 5 indicates the maintenance unit that performs the above displacement.

In this case, for example, the horizontal movement of the maintenance unit 56B (in the arrow m direction) may be performed by meshing the rack 84 with the pinion gear 86, and the upward movement (in the arrow n direction) may be performed by pushing up the maintenance unit 56 by using an electromagnetic plunger, which is not shown in the figure, or alternatively, a cam mechanism that performs such displacement can be provided. As described above, as long as the maintenance unit 56B is configured to be horizontally displaced from the non-maintenance position to a position before the maintenance position, and then displaced upward from the position before the maintenance position to the maintenance position, the head surface 54*a* of the recording head 54 can be more reliably sealed.

Further, although the maintenance unit 56 in the above embodiment moves in the horizontal direction, it may be configured to move in the vertical direction to thereby switch the non-maintenance position and the maintenance position. FIG. 6 illustrates a third embodiment of the present disclosure, and the reference character 56C in FIG. 6 indicates the maintenance unit that displaces in the vertical direction (arrow s direction).

Further, although the head unit 52 in the above embodiment is configured to rotate by rotation of the unit driving gear 66 while the gear 52*c* meshes with the unit driving gear 66, various configuration can be used to rotate the head unit 52. FIG. 7 illustrates a fourth embodiment of the present disclosure, and the reference character 52B indicates the head unit according to the fourth embodiment. In the present embodiment, a wire 76 is attached to the head unit 52B. The wire 76 is configured to be taken up or to be unwound by a take-up pulley 74 via a driven pulley 72. The take-up pulley 74 is rotatable in the clockwise direction or counter-clockwise direction in FIG. 7 by a motor, which is not shown in the figure. Accordingly, the head unit 52B rotates by rotation of the take-up pulley 74 via the wire 76.

Further, instead of the above configuration for rotating the head unit 52B by the wire 76, a link mechanism shown in FIG. 8 can also be used. FIG. 8 illustrates a fifth embodiment of the present disclosure, and the reference character 52C indicates the head unit according to the fifth embodiment. In the present embodiment, a link mechanism 80 is attached to the head unit 52C. The link mechanism 80 operates by a link drive gear 82, and the link drive gear 82 rotates forward and backward by the head unit driving motor 68. Accordingly, the head unit 52C rotates by rotation of the link drive gear 82. The reference character 80A and the dot-dot-dash line indicate the state of the link mechanism when the head unit 52C is switched to the second position.

Further, the dotted line denoted by the reference character 88*a* in FIG. 8 schematically indicates a drive power transmission path between a drive gear 69 mounted on the head unit driving motor 68 and the link drive gear 82, which is actually composed of a plurality of gears and the like.

Further, the present embodiment has another feature that a coordination mechanism 78 that displaces the maintenance unit 56 in coordination with the positional switching of the head unit 52C is provided.

That is, in addition to the path for transmitting a drive power to the link drive gear 82 (drive power transmission path 88*a*), a path for transmitting a drive power to the pinion gear 86 that displaces the maintenance unit 56 (drive power transmission path 88*b*) extends from the drive gear 69 mounted on the rotation shaft of the head unit driving motor 68. As with the drive power transmission path 88*a*, the drive power transmission path 88*b* is composed of a plurality of gears and the like.

As described above, since the coordination mechanism 78 that displaces the maintenance unit 56 in coordination with the positional switching of the head unit 52C is provided in the present embodiment, there is no need of providing separate drive power sources for the head unit 52C and the maintenance unit 56, thereby reducing the cost of the apparatus. The above mentioned coordination mechanism 78 can be applied, not only to the configuration that rotates the head unit by using the link mechanism 80, but also to other units that rotate the head unit shown in FIGS. 3 to 7.

In the present embodiment, a portion of the paper sheet transportation path of the printer 1 downstream from the head facing region 43, which forms a curved path provided with the recording head 54 (head unit 52) disposed inside thereof, is configured as the output path 47 which allows for face down output of the recording paper P. Accordingly, the effect of the present disclosure that does not need of ensuring a large space above the head unit 52 can be effectively used, thereby reducing the dimension of the apparatus in the height direction. Further, since the face down output configuration is provided with the head facing region 43 inclined with respect to the horizontal direction, the transportation path downstream from the head facing region 43 does not need to extend in the horizontal direction to a large extent, thereby reducing the dimension of the apparatus in the width direction (left-right direction in FIG. 1).

In the above embodiments, the following modifications can be made as an example.

(1) In the first embodiment shown in FIGS. 3 and 4, the first sensor 58 and the second sensor 60 may be omitted. In this case, for example, an increase in drive current of the head unit driving motor 68 when the head unit 52 abuts the first abutment unit 62 or the second abutment unit 64 can be detected to thereby detect whether the head unit 52C is assuming the first position (inclined position) or the second position (horizontal position). Alternatively, the first abutment unit 62 and the second abutment unit 64 may be omitted. It is because that the head unit 52 can be positioned at the second position by stopping the head unit driving motor 68 when the first detected section 52*a* is detected by the first sensor 58, and the head unit 52 can be positioned at the first position by stopping the head unit driving motor 68 when the second detected section 52*b* is detected by the second sensor 60.

(2) In the first embodiment shown in FIGS. 3 and 4, or in the other embodiments as well, the position of the head unit 52 can be detected by a rotary encoder instead of the first sensor 58 and the second sensor 60. For example, by mounting a rotary scale on the unit driving gear 66 shown in FIGS. 3 and 4 or on the head unit 52 itself to measure the rotation quantity, the position of the head unit 52 can be detected.

(3) In the embodiments shown in FIGS. 3 to 6, the gear 52*c* in the head unit 52 may be provided as an arc-shaped gear at a position separate from the rotation shaft 53.

(4) As a configuration for rotating the head unit 52, the rotation shaft 53 may be configured to rotate by a motor while the head unit 52 and the rotation shaft 53 are fixed to each other so as to integrally rotate.

(5) In the present embodiment, the recording head 54 is configured as a recording head (so-called line head) having a plurality of ink ejection nozzles 55 (FIG. 2) arranged to cover the entire paper sheet width, which is a recording head that can perform recording onto the entire paper sheet width without a need of movement in the paper sheet width direction. However, the recording head 54 is not limited thereto, and can also be applied to a so-called serial type printer in which the recording head performs recording while moving in the paper sheet width direction. In the case of serial type, since the carriage having the head unit mounted thereon moves in the scan direction, maintenance can be performed by providing a maintenance unit at either end in the scan direction. However, in the case where it is necessary to decrease the size of the apparatus main body in the scan direction, the configuration having the maintenance unit at an end in the scan direction can be replaced with a configuration in which maintenance can be performed by rotating the head unit as the present embodiment.

(6) In the present embodiment, a portion of the paper sheet transportation path downstream from the head facing region 43 is configured as a face down output path. However, the disclosure is not limited thereto, and various other transportation paths may be provided.

What is claimed is:

1. A recording apparatus comprising:

a recording head having a head surface on which liquid ejection nozzles that eject liquid droplets onto a medium are arranged, the recording head being configured to perform recording onto the medium;

a transportation path along which the medium is transported via a head facing region which faces the recording head; and a maintenance unit used for maintenance of the recording head, wherein the head facing region, which is a region of the transportation path which faces the recording head, is inclined with respect to a horizontal direction and to a vertical direction, and the recording head is provided to be rotatable, and by rotating, the recording head can be switched between a first position in which the head surface is inclined along an inclination of the head facing region, the first position being a position for performing recording, and a second position in which the head surface becomes horizontal or becomes more horizontal than in the first position, the second position being a position for performing maintenance by the maintenance unit.

2. The recording apparatus according to claim 1, wherein the recording head is configured to rotate about a rotation shaft which is disposed extending in a direction perpendicular to a transportation direction of the medium.

3. The recording apparatus according to claim 1, wherein the maintenance unit is provided to be displaceable between a non-maintenance position which is separated from the head surface of the recording head which is assuming the first position, and a maintenance position which is close to the head surface of the recording head which is assuming the second position.

4. The recording apparatus according to claim 3, wherein the maintenance unit is disposed at a position to which the recording head comes closer in the horizontal direction when the recording head is switched from the first position to the second position, and is displaced in the horizontal direction.

5. The recording apparatus according to claim 4, wherein the maintenance unit is configured to be horizontally displaced from the non-maintenance position to a position before the maintenance position, and then displaced upward from the position before the maintenance position to the maintenance position.

6. The recording apparatus according to claim 3, wherein the maintenance unit moves in the vertical direction to thereby switch the non-maintenance position and the maintenance position.

7. The recording apparatus according to claim 3, wherein the recording apparatus includes a coordination mechanism, and the coordination mechanism displaces the maintenance unit in coordination with positional switching of the recording head.

8. The recording apparatus according to claim 1, wherein a portion of the transportation path downstream from the head facing region, which forms a curved path provided with the recording head disposed inside thereof, is configured as an output path which allows for face down output of the medium.

9. The recording apparatus according to claim 1, wherein the recording head includes the liquid ejection nozzles arranged over the entire region in the medium width direction, which is a direction perpendicular to the medium transportation direction.

10. The recording apparatus according to claim 1, wherein a portion of the transportation path downstream from the recording head is a curved portion that curves around the recording head.

11. A recording apparatus comprising:

a recording head having a head surface on which liquid ejection nozzles that eject liquid droplets onto a medium are arranged, the recording head being configured to perform recording onto the medium;

a transportation path along which the medium is transported via a head facing region which faces the recording head; and a maintenance unit used for maintenance of the recording head, wherein the head facing region, which is a region of the transportation path which faces the recording head, is inclined with respect to a horizontal direction and to a vertical direction, and wherein the recording head can be switched between a first position in which the head surface is inclined along an inclination of the head facing region, the first position being a position for performing recording, and a second position in which the head surface becomes horizontal or becomes more horizontal than in the first position, the second position being a position for performing maintenance by the maintenance unit.

* * * * *